US005690338A

United States Patent [19]

Cain

[11] Patent Number: 5,690,338

[45] Date of Patent: Nov. 25, 1997

[54] EXPLOSIVE GUNNERY TARGET APPARATUS

[75] Inventor: William Thomas Cain, 1126 Mildred Ave., Bensalem, Pa. 19020

[73] Assignees: William Thomas Cain; Elizabeth J. Cain, both of Bensalem, Pa.

[21] Appl. No.: 729,973

[22] Filed: Oct. 15, 1996

[51] Int. Cl.[6] ..... F41J 5/24

[52] U.S. Cl. ..... 273/393; 273/380

[58] Field of Search ..... 446/211, 212; 273/380, 393, 378

[56] References Cited

U.S. PATENT DOCUMENTS

| | | | |
|---|---|---|---|
| H485 | 7/1988 | Rousseau | 273/380 |
| 2,490,793 | 12/1949 | Fleming . | |
| 2,993,297 | 7/1961 | Bednar et al. . | |
| 3,046,694 | 7/1962 | Holderer | 446/212 |
| 3,049,832 | 8/1962 | Joffe | 446/212 |
| 3,411,778 | 11/1968 | Barry . | |
| 3,664,056 | 5/1972 | Stanzel | 446/212 |
| 3,962,818 | 6/1976 | Pippin, Jr. | 446/212 |
| 4,243,228 | 1/1981 | Marcella . | |
| 4,295,290 | 10/1981 | Boswell | 446/212 |
| 4,335,882 | 6/1982 | Della Rouvere . | |
| 4,373,733 | 2/1983 | Smith, Jr. . | |
| 4,498,677 | 2/1985 | Dapkus . | |
| 4,946,171 | 8/1990 | Merle et al. . | |
| 4,961,585 | 10/1990 | Crawford . | |
| 5,280,918 | 1/1994 | Wu . | |
| 5,403,017 | 4/1995 | Doss, III et al. . | |
| 5,433,646 | 7/1995 | Tarng . | |

FOREIGN PATENT DOCUMENTS

| | | | |
|---|---|---|---|
| 161579 | 3/1955 | Australia | 446/212 |
| 1330882 | 5/1963 | France | 446/212 |

*Primary Examiner*—Mark S. Graham
*Attorney, Agent, or Firm*—Sperry, Zoda & Kane

[57] ABSTRACT

An apparatus for providing immediate and dramatic indication of the accurate striking of a target with a gunnery projectile such as a bullet which includes a rocket apparatus with a body defining a chamber therein for holding fluid such as air and water under pressure. A cap is positioned over an inlet defined in the body and includes a nozzle and a one-way nozzle valve positioned therein. A target zone is indicated on the lower portion of the body and the cap such that when it is struck by a projectile it will launch upwardly indicating a target having been struck. A mounting apparatus is included for providing one or more of the rocket apparatus at an elevated mounted location. A deflector apparatus may be included for increasing accuracy for inexperienced marksmen and a descent control device is included for enhancing the gunnery target display.

19 Claims, 5 Drawing Sheets

EXPLOSIVE GUNNERY TARGET APPARATUS

BACKGROUND OF THE INVENTION

1. Field of the Invention

The present invention deals with the field of devices used in target practice primarily for pistols, handguns, rifles, pellet guns, etc. A means for positive reinforcement is very useful in providing a dramatic indication to a practicing gunman to show that the individual has accurately struck the target or to show that the target has been missed. Numerous designs have been shown for indicating accuracy in targeting. In view of the fact that the firing distances are normally rather large and it is often difficult for a marksman to see whether a target has been accurate hit, the present invention provides a means for dramatically indicating that a target has been hit by providing the launching of a safe, fluid propelled rocket apparatus when a target is accurately struck. Preferably the fluid for launching is a combination of water and air under pressure which provides a very safe means for accuracy indication. Normally with a conventional gun range target a spotter will indicate the accuracy of the shot. Positioning of such spotters is difficult and somewhat dangerous. Alternatively, automated systems for moving a target close to the user after a clip or a specific of shots has been expended is also common. The problem here is that there is no immediate feedback after each round is fired to indicate whether that specific round was fired accurately or not. The present apparatus provides a means for providing that immediate feedback instantly without endangering spotters and by indicating the exact round fired which struck the target zone accurately.

2. Description of the Prior Art

Numerous targeting apparatus have been invented for indicating accurate impact. Some of these targeting apparatus are movable and others are quickly movable such as clay targets, etc. Other devices have been granted for providing water and air under pressure but none have been combined with a rocketing apparatus as in the design of the present invention. Examples of such prior art patents include U.S. Pat. No. 2,490,793 patented Dec. 13, 1949 to F. L. Fleming on a "Gunnery Target"; and U.S. Pat. No. 2,993,297 patented Jul. 25, 1961 to W. A. Bednar et al and assigned to Research Unlimited, Inc. on a "Toy Rocket"; and U.S. Pat. No. 3,411,778 patented Nov. 19, 1968 to R. M. Barry on a "Balloon Target Missile"; and U.S. Pat. No. 4,243,228 patented Jan. 6, 1981 to J. Marcella on a "Remotely-Perceptible Impact-Indicating Projectile Target"; and U.S. Pat. No. 4,335,882 patented Jun. 22, 1982 to L. Della Rovere on a "Sheet-Metal Target Pigeon"; and U.S. Pat. No. 4,373,733 patented Feb. 15, 1983 to M. Smith, Jr. on a "Reactionary Human Silhouette Target"; and U.S. Pat. No. 4,498,677 patented Feb. 12, 1985 to J. Dapkus on an "Explosive Target"; and U.S. Pat. No. 4,946,171 patented Aug. 7, 1990 to T. Merle et al and assigned to Eastman Kodak Company on a "Live Fire Target Modular Support Structure"; and U.S. Pat. No. 4,961,585 patented Oct. 9, 1990 to J. Crawford on a "Flying Target With Marker"; and U.S. Pat. No. 5,280,918 patented Jan. 25, 1994 to J. Wu on a "Beacon Target"; and U.S. Pat. No. 5,403,017 patented Apr. 4, 1995 to S. Doss, III et al and assigned to Unisys Corporation on a "Target Lifter With Impact Sensing"; and U.S. Pat. No. 5,433,646 patented Jul. 18, 1995 to M. Tarng on a "Water Gun Launching Water Grenade".

SUMMARY OF THE INVENTION

The present invention provides a gunnery target which has an explosive rocket member which when accurately struck by a gunner projectile such as a bullet or shot pellet will explosively launch preferably upwardly to indicate an accurate target hit.

The rocketing apparatus includes a body having an interior chamber therein with an inlet defined in the body which is in fluid flow communication with respect to the interior chamber. The interior chamber is adapted preferably to receive pressurized fluid therein such as water and air under pressure of as much as ninety pounds per square inch or more. A cap is designed selectively to be positioned extending over the inlet and is detachably securable to the body adjacent the inlet. This cap preferably includes a nozzle therein which defines a nozzle bore extending therethrough which is in fluid flow communication with respect to the interior chamber through the inlet defined therein.

A nozzle valve such as a stem valve or other valve configuration can be positioned within the nozzle bore for selectively controlling fluid flow therethrough and through the inlet into the interior chamber. A target zone is preferably defined as the area to be struck by a gunnery projectile to indicate an accurate impact. A portion of the target zone is the first target area which includes preferably a lowermost portion of the body in the area immediately adjacent to the inlet defined therein. A second target area is also included within the target zone which is defined as the exterior surface of the cap and the nozzle. This first target area and this second target area are preferably formed of a plastic or other material such as being capable of being easily penetrated by a bullet or other projectile to facilitate the expulsion of pressurized fluid such as water and air outwardly from the interior chamber causing explosive propulsion of the rocket apparatus preferably in an upward directly to indicate an accurate shot.

The apparatus of the present invention may further include a mounting device for holding at least one or more of the rocket apparatus therein in order to facilitate impacting thereof by a projectile.

This mounting apparatus is designed preferably to maintain the rocket apparatus oriented with the target zone thereof along the lowermost area in order to aid launching of the rocket upwardly responsive to impacting of the target zone by a gunnery projectile.

The mounting apparatus preferably also includes a mounting hole designed to receive the cap of the rocket positioned extending therewithin with the body extending upwardly therefrom in order to facilitate launching of a rocket apparatus upwardly responsive to striking of the target zone by a gunnery projectile. In an alternative configuration the mounting apparatus can include a mounting cup which is preferably arcuate and concave in such a manner as to receive the body means of the rocket apparatus therewithin with the target zone maintained lowermost and with the cap means extending downwardly into the mounting cup to facilitate holding of the target zone in an elevated position to facilitate accurate impacting thereof with a gunnery projectile.

An alternative configuration of the present invention may further include a descent control device which is designed to be attached with respect to the body of the rocket apparatus for controlling descent thereof after launching upwardly responsive to striking of the target zone by a gunnery projectile. This descent control means preferably includes air deflection means for controlling and particularly for decreasing the descent speed of the rocket after completion of launching vertically upward thereof in order to further enhance the display of an accurate shot.

In the preferred configuration the descent control device is detachably securable to the external surface of the body and is desired to be positioned to snap in place over tabs defined in the external surface of the body. Preferably the descent control device will be of a plastic material and will be somewhat resilient such as to be capable of being stretched to extend over the tabs and to be held in place thereby. The descent control device preferably will include the individual air deflection means or vanes which will extend approximately parallel to the body during upward launching movement in order to minimize air resistance thereof during vertical launching and propulsion. Once the propulsion has terminated the rocket body will then start to move downwardly which preferably will cause the deflection vanes to move outwardly to the laterally extended position to achieve deflection of air an decrease the speed of descent of the rocket to enhance the display thereof. In this manner the air deflection vanes during launching will be positioned approximately parallel to the body of the rocket and during descent will be positioned approximately perpendicular to the body of the rocket such that air will not be deflected during launching and air will be caught and deflected thereby during descent.

Preferably the nozzle valve of the apparatus of the present invention will be a one-way valve which allows filling of the interior chamber with fluid such as water and air under pressure. Such a one-way valve construction would prevent the loss of pressure from the interior chamber outwardly into the ambient environment.

In the preferred configuration the cap and the nozzle are formed as a single integral piece molded together out of preferably a plastic material. Also in a preferred configuration the body of the rocket will include a lower fin means for facilitating the guiding of upward movement of the rocket apparatus during launching.

In order to allow use of the targeting apparatus of the present invention by many different skill levels of the marksman, the apparatus preferably includes a deflector guide means which is capable of being positioned adjacent to the target zone to facilitate striking thereof by a gunnery projectile. This deflector guide means preferably includes an outlet aperture and at least one deflector plate. Preferably the deflector plate is of a concave arcuate configuration and is designed to deflect gunnery projectiles therefrom to urge movement through the aperture means. By positioning of the aperture means adjacent to the target zone of the rocket apparatus accuracy is enhanced by "widening of the sweet spot" for those less skilled marksman. The cap is designed to be detachably secured with respect to the body in position extending over the inlet thereof. To facilitate this connection a cap securement means may be included such as a thread means and, in particular, such as a lefthanded thread means to enhance detachable affixing of the cap with respect to the rocket body.

It is an object of the present invention to provide an explosive gunnery target apparatus having a rocket member responsive to being accurately struck by a gunnery projectile to explosively launch wherein dramatic indication of an accurate impact or bullseye is indicated.

It is an object of the present invention to provide an explosive gunnery target apparatus having a rocket member responsive to being accurately struck by a gunnery projectile to explosively launch wherein use by skilled marksmen is enhanced.

It is an object of the present invention to provide an explosive gunnery target apparatus having a rocket member responsive to being accurately struck by a gunnery projectile to explosively launch wherein use by less skilled marksmen can be significantly enhanced by use of a deflecting apparatus for widening of the sweet spot.

It is an object of the present invention to provide an explosive gunnery target apparatus having a rocket member responsive to being accurately struck by a gunnery projectile to explosively launch wherein a minimum number of moving parts is utilized.

It is an object of the present invention to provide an explosive gunnery target apparatus having a rocket member responsive to being accurately struck by a gunnery projectile to explosively launch wherein dramatic indication of an accurate impact is achieved by launching of a rocket without any dangerous chemicals since only water and/or air are included under pressure.

It is an object of the present invention to provide an explosive gunnery target apparatus having a rocket member responsive to being accurately struck by a gunnery projectile to explosively launch wherein easy quick replacement of the body means of the rocket apparatus is achievable for repeated usage of portions of the apparatus of the invention.

It is an object of the present invention to provide an explosive gunnery target apparatus having a rocket member responsive to being accurately struck by a gunnery projectile to explosively launch wherein a nozzle valve provides a means for easily facilitating the application of fluid under pressure to the interior chamber of the body.

It is an object of the present invention to provide an explosive gunnery target apparatus having a rocket member responsive to being accurately struck by a gunnery projectile to explosively launch wherein water and air by pressure as great as ninety pounds per square inch can be utilized to increase the dramatic impact of the launching of the rocket apparatus.

It is an object of the present invention to provide an explosive gunnery target apparatus having a rocket member responsive to being accurately struck by a gunnery projectile to explosively launch wherein a mounting means may be included which facilitating holding one or more of the rocket apparatus in an array for providing multiple targets during gunnery practice.

It is an object of the present invention to provide an explosive gunnery target apparatus having a rocket member responsive to being accurately struck by a gunnery projectile to explosively launch wherein a descent control device is included to increase the display subsequent to an accurate gunnery projectile impact.

It is an object of the present invention to provide an explosive gunnery target apparatus having a rocket member responsive to being accurately struck by a gunnery projectile to explosively launch wherein a descent control device is included which does not decrease the speed of launching but does decrease the speed of descent.

It is an object of the present invention to provide an explosive gunnery target apparatus having a rocket member responsive to being accurately struck by a gunnery projectile to explosively launch wherein a plurality of fins may be included on the external surface of the body to facilitate upward alignment of launching of the explosive gunnery target apparatus of the present invention.

It is an object of the present invention to provide an explosive gunnery target apparatus having a rocket member responsive to being accurately struck by a gunnery projectile to explosively launch wherein danger is minimized.

It is an object of the present invention to provide an explosive gunnery target apparatus having a rocket member responsive to being accurately struck by a gunnery projectile to explosively launch wherein safety is significantly enhanced.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
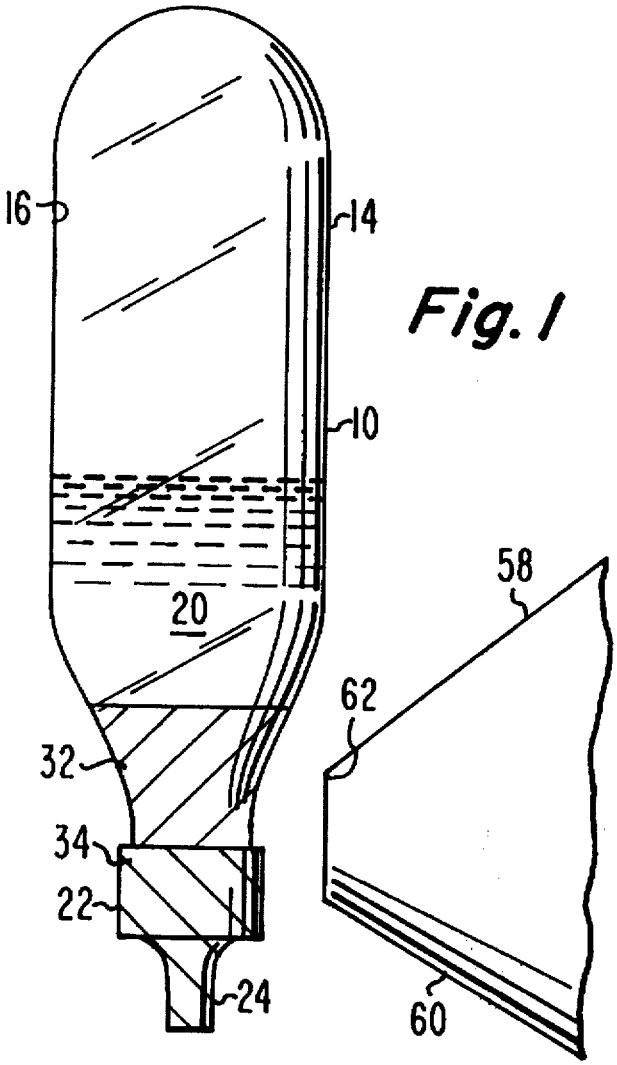
FIG. 1 is a front plan view of an embodiment of the apparatus of the present invention shown ready for gunnery practice with a deflector guide in place.
Figure 2:
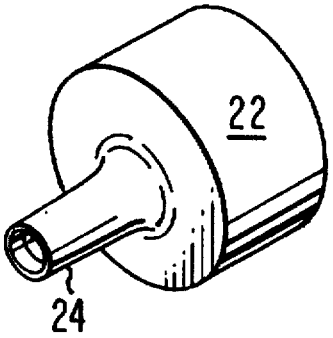
FIG. 2 is a perspective illustration of an apparatus of the cap of the present invention.

The present invention provides an explosive gunner target apparatus which uses a rocket apparatus 10 which when struck accurately by a gunner projectile 12 launches upwardly to simulate a blastoff to celebrate the accurate strike. Such gunner projectiles 12 can comprise conventional bullets, shots, musketballs, pellets or any other projectile capable of being propelled by a gun of any type or sort.

The rocket apparatus 10 of the present invention includes a body 14 which is preferably longitudinal and generally cylindrical with a rounded upper portion and defining an inlet 18 in the lower portion thereof. The body 14 preferably also defines an interior chamber 16 adapted to receive fluid 20 under pressure therein. Preferably this fluid will comprise an air or air and water under pressure of as high as ninety pounds per square inch.

Figure 3:
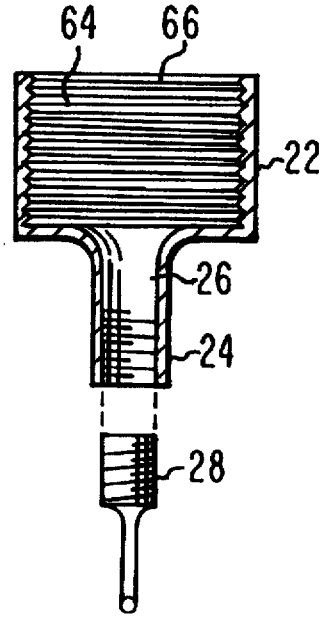
FIG. 3 is a cross-sectional view of an embodiment of the cap of the present invention.
Figure 4:
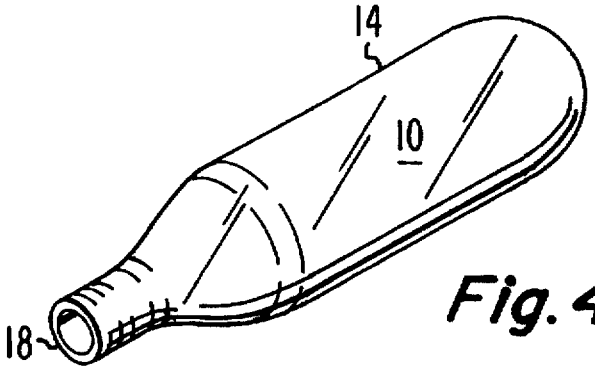
FIG. 4 is a perspective illustration of an embodiment of the body of the present invention.

A cap 22 is detachably securable by a cap securement apparatus 64 such as thread means 66 with respect to the body 14 of the rocket apparatus 10 such as to extend over the inlet 18 thereof. Thread means 66 preferably are of a lefthanded threaded configuration to facilitate detachable securement of the cap 22 in position over the inlet 18. Cap 22 preferably also defines a nozzle 24 integrally formed therewith preferably and extending outwardly therefrom. Nozzle 24 defines a nozzle bore 26 extending therethrough such as to be in fluid flow communication with the inlet 18 and with the interior chamber 16 of the rocket apparatus 10. A nozzle valve 28 such as a one-way valve means may be positioned within the nozzle bore 26 to control the flow of fluid such as water and air through the nozzle bore 26 and the inlet 18 into the interior chamber 16 and to prevent fluid movement outwardly therefrom. This nozzle valve 28 preferably takes the form of any type of a conventional one-way valve such as might include a valve stem apparatus as shown best in FIG. 3.

The rocket apparatus 10 of the present invention preferably defines a target zone 30. This target zone is the preferred contact area for the impacting of a gunnery projectile 12 for indicating an accurate impact. Target zone 30 preferably comprises two separate areas. Initially a first target area 32 is defined as the portion of the body 14 adjacent to the inlet 18 in the lowermost area 38 thereof. A second target area 34 is included which defines basically the entire area of the cap 22 and the nozzle 24 thereof. The second target area 34 preferably is positioned below the first target area 32. These two target areas 32 and 34 together combine to form the target zone 30. If a gunnery projectile 12 contacts any area within target zone 30, in accordance with the operation of the present invention, the body 14 will be penetrated causing the fluid 20 under pressure to expel downwardly and the rocket apparatus 10 to launch in a generally upward direction.

Figure 6:
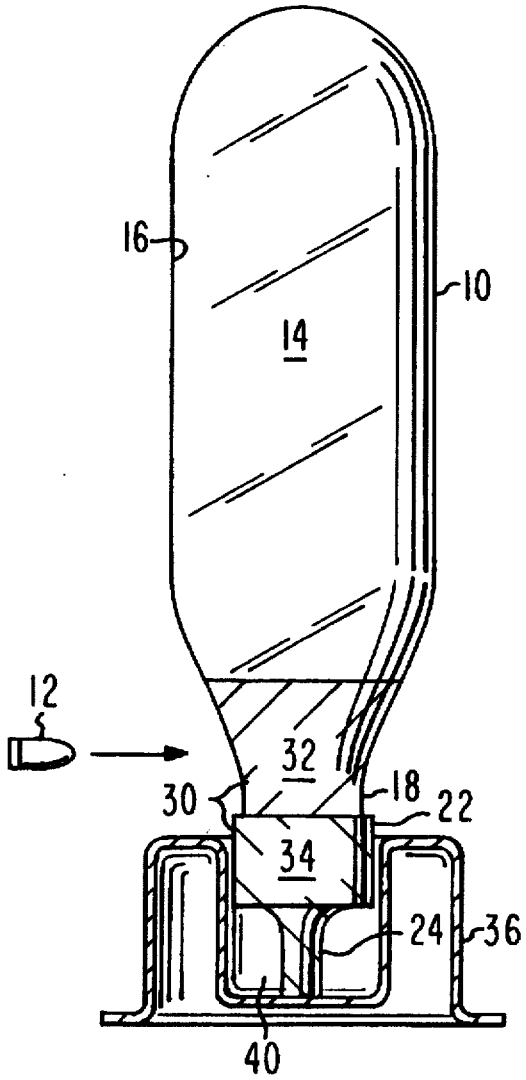
FIG. 6 is a front plan view of an embodiment of the rocket apparatus of the present invention shown positioned held by an embodiment of the mounting device.
Figure 13:
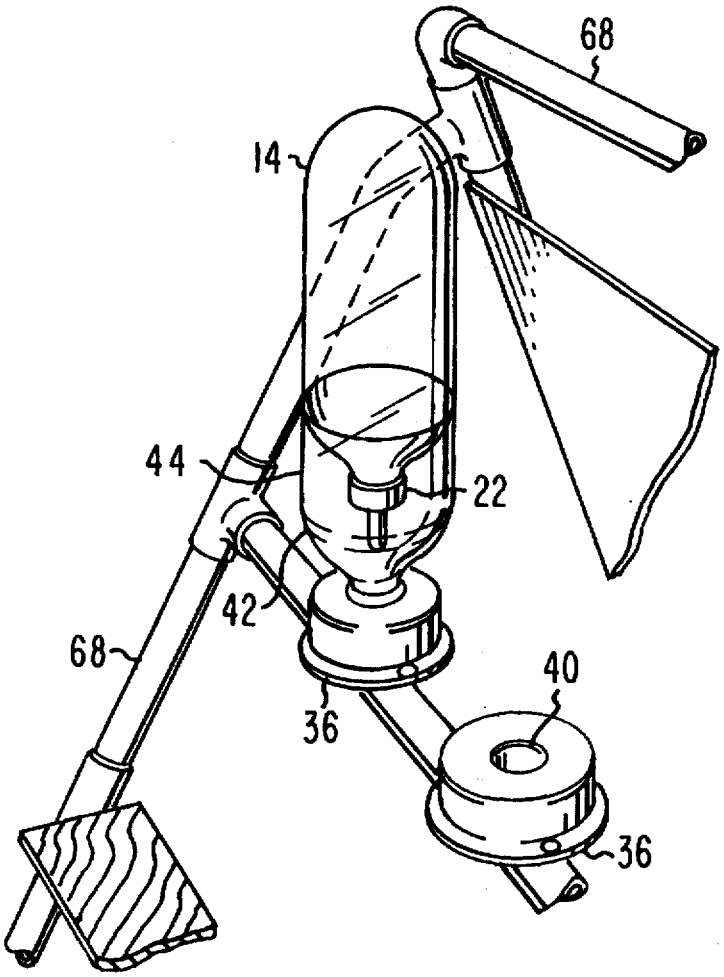
FIG. 13 is a perspective illustration of an embodiment of the rocket apparatus of the present invention shown in position retained by an embodiment of the mounting cup.
Figure 12:
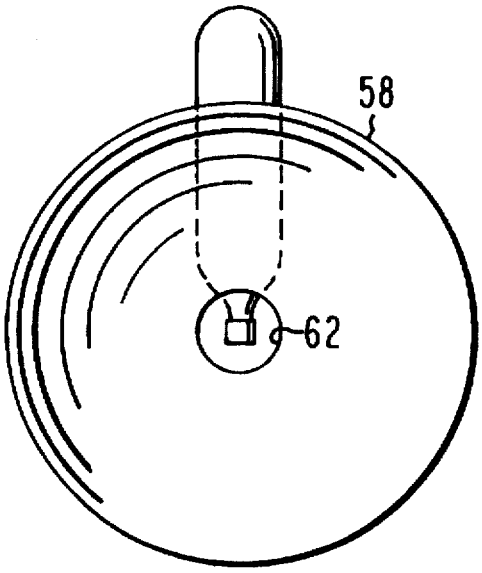
FIG. 12 is a front plan view of an embodiment of the deflector guide apparatus of the present invention.

To facilitate holding of the rocket apparatus 10 in proper vertical orientation a mounting device 36 may be included which can be of a torroidal shape as shown in FIGS. 6 and 13. Preferably the mounting device 36 defines a mounting hole 40 therein adapted to receive the cap 22 therein for presenting the target zone 30 in a manner to be easily struck by the practicing marksman.

Alternatively a mounting cup 42 can be included as shown best in FIG. 13. This mounting cup provides a means for elevating the position of the rocket apparatus 10 with respect to the mounting device 36. With the configuration of the mounting cup 42 being generally concave and arcuate, the impacting of a gunner projectile 12 with the second target area 34 is significantly aided. Preferably the mounting cup 42 is formed of a thin plastic material such that any gunnery projectile 12 can penetrate it to contact the portion of the rocket apparatus 10 positioned within the mounting cup 42.

In a preferred configuration the apparatus of the present invention includes a descent control device 46. This control device preferably includes a plurality of air deflection means 50 which are movable between a retracted position 52 and an extended position 54. In the extended position 54 the air deflection means 50 will be designed to maximize deflection of air to decrease the speed of descent after explosively launching of the rocket apparatus 10 of the present invention. In the retracted position 52 the air deflection means 50 will be retracted such as to prevent deflection of air by the air deflection means 50 to thereby not impede the speed of launching upwardly. In the preferred means of operation the air deflection members or vanes 50 will be movable flexibly between the retracted position 52 extending generally parallel to the outside surface of the body 14 during launching movement and would be movable to a position extending perpendicularly with respect to the outside surface of the body 14 which is the extended position 54 such as to deflect air and decrease the speed of descent of the rocket apparatus after launching has terminated and during descent to ground level.

Figure 7:
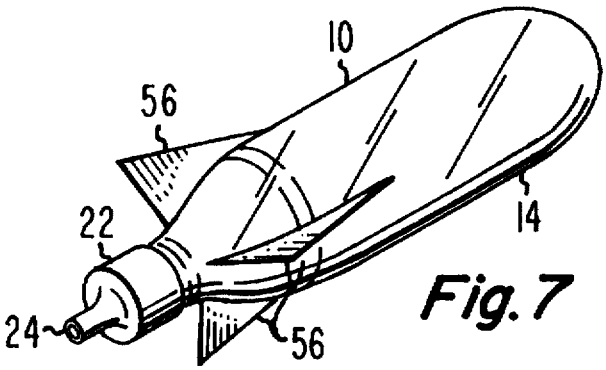
FIG. 7 is a perspective illustration of an alternative embodiment of the body of the present invention shown with lower fins included.
Figure 8:
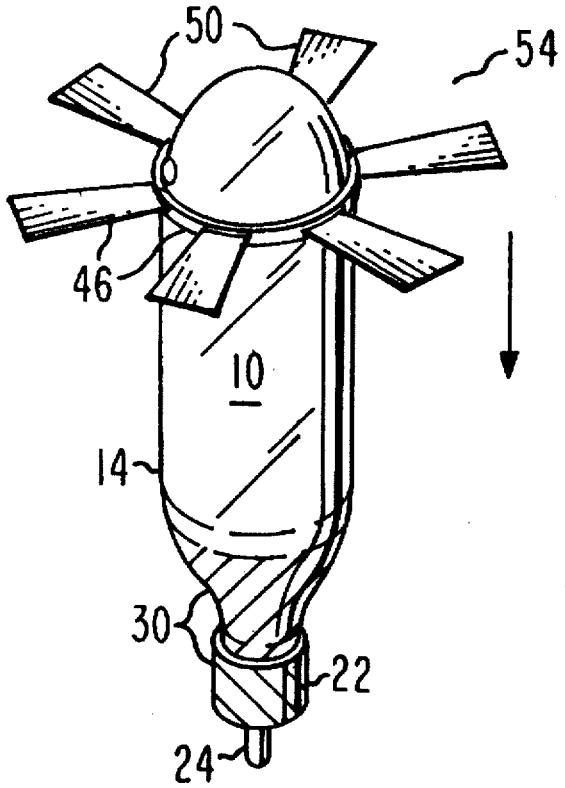
FIG. 8 is an illustration of an embodiment of the present invention with the detachable air deflection device shown in the extended position with the rocket apparatus in descent.
Figure 9:
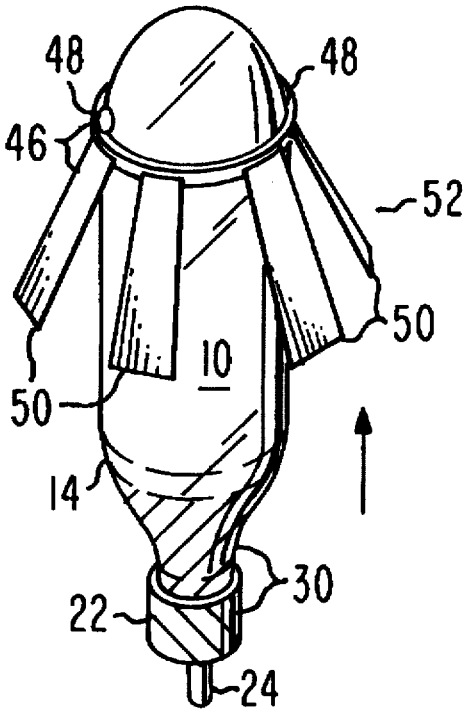
FIG. 9 is an illustration of the embodiment shown in FIG. 8 with the rocket apparatus shown launching upwardly.

The guiding of upward movement of the rocket apparatus 10 to maintain upward orientation is enhanced by the inclusion of a plurality of lower fins 56 as shown best in FIG. 7.

The descent control device 46 is preferably detachably securable to the external surface of the body 14 of the rocket apparatus 10 by way of a tab means 48 integrally formed in the external surface of the body 14 with the descent control device 46 formed of a flexibly resilient material which can resiliently expand and snap over the tabs 48 for retaining of air deflection vanes 50 as desired with respect to the body 14 for usage during launching and descent.

The present invention also may preferably include as an alternative embodiment the use of a deflector guide means 58. Such a deflector guide means is designed to enhance the means of obtaining accurate impact even by unskilled marksmen. The deflector guide means 58 preferably is formed of a deflector plate 60 extending about an outlet aperture 62. The outlet aperture 62 is preferably positioned adjacent to the target zone 30. The deflector plate 60 is preferably of a concave arcuate shape somewhat similar to a funnel such that a gunner projectile 12 can contact the deflector plate 60 and be deflected through the outlet aperture 62 such as to be brought within the target zone 30. Such a shot normally would not be within the target zone but would be counted as a miss but with the use of a deflector guide means 58 the area of the target zone and the effected "sweet spot" of this explosive gunnery target apparatus is increased.

Figure 11:
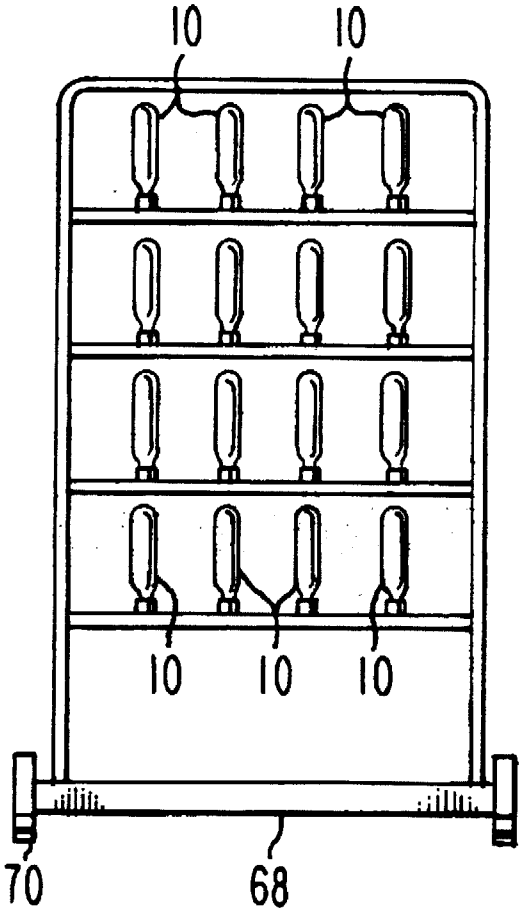
FIG. 11 is a front plan illustration of the embodiment shown in FIG. 10.
Figure 10:
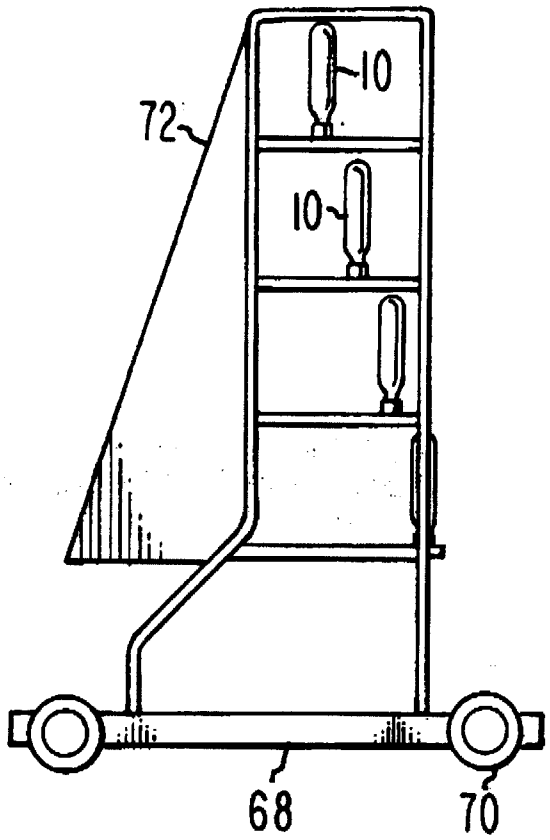
FIG. 10 is an embodiment of the apparatus of the present invention shown displayed in an array on a target stand in right side plan view.

In operation the nozzle valve 28 can receive fluid under pressure passing in a one-way direction therethrough. This fluid preferably is water and/or air of approximately ninety pounds per square inch. Once the pressurized rocket apparatus 10 is fully pressurized it can then be placed into a mounting cup 42 and positioned singly or in an array as shown by the target display stand 68 in FIGS. 10 and 11. These target display stands 68 are mounted on a plurality of rollers 70 to facilitate movement of the target apparatus to a chosen shooting area. Also the design may include a plurality of horizontally extending shelves for holding one or more rows of explosive gunnery target devices. A safety plate 72 may also be positioned in the rear portion thereof for deflecting the spent gunnery projectiles downwardly for enhancing safety thereof. Such a safety plate can be formed of safety plate glass or plexiglass or bulletproof or any other convenient bulletproof material.

Figure 5:
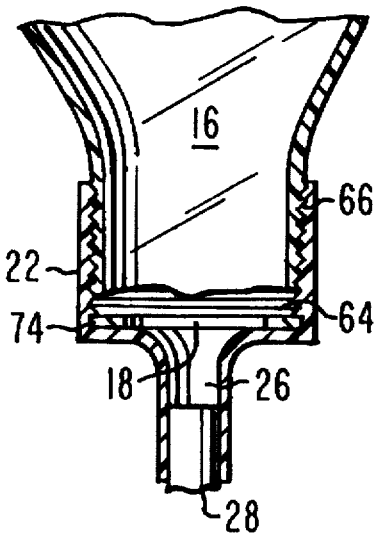
FIG. 5 is a cross-sectional view of an embodiment of the cap of the present invention with a nozzle valve shown positioned therewithin.

In the construction shown best in FIG. 5 a gasket 74 may be included to eliminate any leakage of fluid under pressure outwardly through the inlet passed the cap.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. An explosive gunnery target apparatus having a separable rocket member responsive to being accurately struck by a gunnery projectile to explosively launch comprising:

A. a rocket apparatus comprising:

(1) a body means defining a interior chamber means therewithin and an inlet means defined therein in fluid flow communication with respect to said interior chamber means, said interior chamber means adapted to receive and retain pressurized fluid therewithin;

(2) a cap means detachably securable with respect to said body means positioned extending over said inlet means defined therein for selectively controlling fluid flow therethrough, said cap means including a nozzle means defining a nozzle bore means extending therethrough in fluid flow communication with said interior chamber means;

(3) a nozzle valve means positioned within said nozzle bore means to selectively control fluid flow through said nozzle bore means and said inlet means into said interior chamber means;

(4) a target zone defining the desired area to be struck by the gunnery projectile comprising:

(a) a first target area including a portion of said body means in an area adjacent said inlet means defined therein;

(b) a second target area defined on said cap means and said nozzle means, said first target area and said second target area being capable of being penetrated by a gunnery projectile to facilitate expulsion of pressurized fluid outwardly from said interior chamber means causing explosive propulsion of said rocket apparatus responsive to projectile penetration of said target zone;

B. a mounting means for holding at least one of said rocket apparatus therein to facilitate impacting thereof by a projectile; and C. a deflector guide means positionable adjacent said target zone for facilitating striking thereof by a gunnery projectile.

2. An explosive gunnery target apparatus having a separable rocket member responsive to being accurately struck by a gunnery projectile to explosively launch as defined in claim 1 wherein said mounting means maintains said rocket apparatus oriented with said target zone along a lowermost area thereof to facilitate launch of said rocket apparatus upwardly responsive to a gunnery projectile impacting said target zone.

3. An explosive gunnery target apparatus having a separable rocket member responsive to being accurately struck by a gunnery projectile to explosively launch as defined in claim 1 wherein said mounting means defines a mounting hole means therein adapted to receive said cap means positioned extending therewithin with said body means extending upwardly therefrom to facilitate launching of said rocket apparatus responsive to striking of said target zone by a gunnery projectile.

4. An explosive gunnery target apparatus having a separable rocket member responsive to being accurately struck by a gunnery projectile to explosively launch as defined in claim 1 wherein said mounting means includes a mounting cup means being generally concave and arcuate to receive said body means of said rocket apparatus therewithin with said target zone maintained lowermost and said cap means extending downwardly thereinto to facilitate striking of said target zone by a gunnery projectile.

5. An explosive gunnery target apparatus having a separable rocket member responsive to being accurately struck by a gunnery projectile to explosively launch as defined in claim 1 further comprising a descent control device attached with respect to said body means of said rocket apparatus for controlling descent thereof after launching upwardly responsive to striking of said target zone by a gunnery projectile.

6. An explosive gunnery target apparatus having a separable rocket member responsive to being accurately struck by a gunnery projectile to explosively launch as defined in claim 5 wherein said descent control device includes an air deflection means extendable outwardly from said body means to control descent of said rocket apparatus after explosive launching thereof.

7. An explosive gunnery target apparatus having a separable rocket member responsive to being accurately struck by a gunnery projectile to explosively launch as defined in claim 6 wherein said air deflection means is movable responsive to upward movement of said rocket apparatus to extend generally parallel to said body means to minimize air resistance thereof and maximize upward launch movement, said air deflection means being movable responsive to downward movement of said rocket apparatus to extend generally perpendicularly outwardly from said body means to maximize air resistance thereof for descent control.

8. An explosive gunnery target apparatus having a separable rocket member responsive to being accurately struck by a gunnery projectile to explosively launch as defined in claim 5 wherein said descent control device is detachably secured to said body means of said rocket apparatus to allow optional use thereof.

9. An explosive gunnery target apparatus having a separable rocket member responsive to being accurately struck by a gunnery projectile to explosively launch as defined in claim 1 wherein said nozzle valve means includes a one-way valve means positioned within said nozzle bore means to allow fluid to pass inwardly therethrough into said interior chamber means and to prevent fluid flow outwardly therethrough from said interior chamber means.

10. An explosive gunnery target apparatus having a separable rocket member responsive to being accurately struck by a gunnery projectile to explosively launch as defined in claim 1 wherein said cap means and said nozzle means together form a single integral piece.

11. An explosive gunnery target apparatus having a separable rocket member responsive to being accurately struck by a gunnery projectile to explosively launch as defined in claim 1 wherein said body means includes lower fin means for guiding upward movement of said rocket apparatus during launching thereof responsive to a gunnery projectile striking said target zone.

12. An explosive gunnery target apparatus having a separable rocket member responsive to being accurately struck by a gunnery projectile to explosively launch as defined in claim 1 wherein said deflector guide means defines an outlet aperture means adjacent said target zone and wherein said deflector guide means includes at least one deflector plate means to guide a gunnery projectile through said outlet aperture after contacting thereof to facilitate striking of said target zone positioned thereadjacent.

13. An explosive gunnery target apparatus having a separable rocket member responsive to being accurately struck by a gunnery projectile to explosively launch as defined in claim 12 wherein said deflector plate means is concave.

14. An explosive gunnery target apparatus having a separable rocket member responsive to being accurately struck by a gunnery projectile to explosively launch as defined in claim 12 wherein said deflector plate means is arcuate.

15. An explosive gunnery target apparatus having a separable rocket member responsive to being accurately struck by a gunnery projectile to explosively launch as defined in claim 1 wherein said body means is capable of maintaining a mixture of water and air therein under pressure of at least as high as 90 pounds per square inch.

16. An explosive gunnery target apparatus having a separable rocket member responsive to being accurately struck by a gunnery projectile to explosively launch as defined in claim 1 wherein said first target area and said second target area are made of plastic material capable of being penetrated by a gunnery projectile.

17. An explosive gunnery target apparatus having a separable rocket member responsive to being accurately struck by a gunnery projectile to explosively launch as defined in claim 1 further including a cap securement means for detachably securing of said cap means to said body means over said inlet means thereof.

18. An explosive gunnery target apparatus having a rocket member responsive to being accurately struck by a gunnery projectile to explosively launch comprising:

A. a rocket apparatus comprising:

(1) a body means defining a interior chamber means therewithin and an inlet means defined therein in fluid flow communication with respect to said interior chamber means, said interior chamber means adapted to receive and retain pressurized air and water therein, said body means including lower fin means for guiding upward movement of said rocket apparatus during launching thereof;

(2) a cap means detachably securable with respect to said body means positioned extending over said inlet means defined therein for selectively controlling fluid flow therethrough, said cap means including a nozzle means defining a nozzle bore means extending therethrough in fluid flow communication with said interior chamber means;

(3) a nozzle valve means securable within said nozzle bore means to selectively control fluid flow through said nozzle bore means and said inlet means into said interior chamber means, said nozzle valve means including an one-way valve means positioned within said nozzle bore means to allow fluid to pass inwardly therethrough into said interior chamber means and to prevent fluid flow outwardly therethrough from said interior chamber means;

(4) a target zone defining the desired area to be struck by the gunnery projectile comprising:

(a) a first target area including a portion of said body means in an area adjacent said inlet means defined therein;

(b) a second target area defined on said cap means and said nozzle means, said first target area and said second target area being capable of being penetrated by a gunnery projectile to facilitate expulsion of pressurized air and water outward from said interior chamber means causing explosive propulsion of said rocket apparatus responsive to projectile penetration of said target zone;

B. a mounting means for holding at least one of said rocket apparatus therein to facilitate impacting thereof by a projectile, said mounting means adapted to maintain said rocket apparatus oriented with said target zone along the lowermost area thereof to facilitate launch of said rocket apparatus upwardly responsive to a gunnery projectile penetrating said target zone, said mounting means includes a mounting cup means being generally arcuate to receive said body means of said rocket apparatus therewithin with said target zone maintained lowermost and said cap means extending downwardly thereinto to facilitate striking of said target zone with a gunnery projectile, said mounting cup means of said mounting means defining a mounting hole means therein adapted to receive said cap means extending therewithin with said body means extending upwardly therefrom to facilitate launching of said rocket apparatus responsive to striking of said target zone by a gunnery projectile;

C. a descent control device attached with respect to said body means of said rocket apparatus for controlling descent thereof after launching upwardly responsive to striking of said target zone by a gunnery projectile, said descent control device including an air deflection means extendable outwardly from said body means to control descent of said rocket apparatus after explosive launching thereof; and D. a deflector guide means positionable adjacent said target zone.. for facilitating striking thereof by a gunnery projectile.

19. An explosive gunnery target apparatus having a rocket member responsive to being accurately struck by a gunnery projectile to explosively launch comprising:

A. a rocket apparatus comprising:

(1) a body means defining a interior chamber means therewithin and an inlet means defined therein in fluid flow communication with respect to said interior chamber means, said interior chamber means adapted to receive and retain pressurized air and water therein, said body means being capable of maintaining water and air under pressure therein at least as high as 90 pounds per square inch;

(2) a cap means detachably securable with respect to said body means positioned extending over said inlet means defined therein for selectively controlling fluid flow therethrough, said cap means including a nozzle means integral therewith and defining a nozzle bore means extending therethrough in fluid flow communication with said interior chamber means;

(3) a nozzle valve means securable within said nozzle bore means to selectively control fluid flow through said nozzle bore means and said inlet means into said interior chamber means, said nozzle valve means including an one-way valve means positioned within said nozzle bore means to allow fluid to pass inwardly therethrough into said interior chamber means and to prevent fluid flow outwardly therethrough from said interior chamber means;

(4) a target zone of plastic material capable of being penetrated by a gunnery projectile and defining the desired area to be struck by the gunnery projectile comprising:

(a) a first target area including a portion of said body means in an area adjacent said inlet means defined therein;

(b) a second target area defined on said cap means and said nozzle means, said first target area and said second target area being capable of being penetrated by a gunnery projectile to facilitate expulsion of pressurized air and water outward from said interior chamber means causing explosive propulsion of said rocket apparatus responsive to projectile penetration of said target zone;

B. a mounting means for holding at least one of said rocket apparatus therein to facilitate impacting thereof by a projectile, said mounting means adapted to maintain said rocket apparatus oriented with said target zone along the lowermost area thereof to facilitate launch of said rocket apparatus upwardly responsive to a gunnery projectile penetrating said target zone, said mounting means defining a mounting hole means therein adapted to receive said cap means extending therewithin with said body means extending upwardly therefrom to facilitate launching of said rocket apparatus responsive to striking of said target zone by a gunnery projectile;

C. a descent control device detachably secured with respect to said body means of said rocket apparatus for controlling descent thereof after launching upwardly responsive to striking of said target zone by a gunnery projectile, said descent control device including an air deflection means extendable outwardly from said body means to control descent of said rocket apparatus after explosive launching thereof, said air deflection means being movable responsive to upward movement of said rocket apparatus to extend generally parallel to said body means to minimize air resistance thereof, said air deflection means being movable responsive to downward movement of said rocket apparatus to extend generally perpendicularly outwardly from said body means to maximize air resistance thereof; and D. a deflector guide means positioned adjacent said target zone for facilitating striking thereof by a gunnery projectile, said deflector guide means defining an outlet aperture means adjacent said target zone and wherein said deflector guide means includes at least one deflector plate means being arcuate to guide a gunnery projectile through said outlet aperture after contacting thereof to facilitate striking of said target zone positioned thereadjacent.

* * * * *